United States Patent [19]

Ueda

[11] Patent Number: 5,049,938

[45] Date of Patent: Sep. 17, 1991

[54] ABNORMALITY DETECTING SYSTEM IN AN IMAGE FORMING APPARATUS

[75] Inventor: Masahide Ueda, Osaka, Japan

[73] Assignee: Minolta Camera Kabushiki Kaisha, Osaka, Japan

[21] Appl. No.: 507,128

[22] Filed: Apr. 10, 1990

[30] Foreign Application Priority Data

Apr. 11, 1989 [JP] Japan ..... 1-91670
Apr. 11, 1989 [JP] Japan ..... 1-91671

[51] Int. Cl.[5] ..... G03G 00/00

[52] U.S. Cl. ..... 355/246; 355/204; 355/208

[58] Field of Search ..... 355/206, 208, 205, 204, 355/209, 246, 207; 371/7, 27, 29.1

[56] References Cited

U.S. PATENT DOCUMENTS

| | | | |
|---|---|---|---|
| 4,592,645 | 6/1986 | Kanai et al. | 355/206 |
| 4,739,365 | 4/1988 | Hino | 355/246 |
| 4,931,835 | 6/1990 | Higgins et al. | 355/246 X |
| 4,956,669 | 9/1990 | Nakamura | 355/208 |
| 4,958,188 | 9/1990 | Miyamoto | 355/206 |

*Primary Examiner*—R. L. Moses
*Assistant Examiner*—Sandra L. Hoffman
*Attorney, Agent, or Firm*—Burns, Doane, Swecker & Mathis

[57] ABSTRACT

An image forming apparatus for developing an electrostatic latent image formed on the surface of a photosensitive member into a visual image by the use of two-component developer consisting of toner and carrier. The apparatus is provided with a developing unit, which accommodates the developer and in which screw rollers are rotatably mounted for agitating the developer. The apparatus is further provided with an abnormality detecting system for detecting abnormalities which are liable to occur in the developing unit. The abnormality detecting system includes a toner density sensor for detecting the density of toner accommodated in the developing unit. In the normal condition, the toner density detected by the toner density sensor regularly fluctuates as the developer accommodated in the developing unit is agitated by the screw rollers. The abnormality detecting system further includes a control circuit, in which the cycle of fluctuation of the toner density is compared with that of agitation caused by the screw rollers. When both the cycles do not coincide with each other, the control circuit outputs a signal indicating that some abnormality has occurred in the apparatus.

15 Claims, 15 Drawing Sheets

51
53
55
+15V
-15V
+15V
-15V
Va
Vb
Ve
Vd
Vf
F→V
Vc
Vg
Vh
Vi
Vj
Vk
Vl
Vm
Vn
Vo
P1
P2
P3
P4
P5
P6
CPU
INPUT
OUTPUT
+24V
MAIN MOTOR

ABNORMALITY DETECTING SYSTEM IN AN IMAGE FORMING APPARATUS

BACKGROUND OF THE INVENTION

1. Field of the Invention

The present invention relates to a system for detecting abnormalities in an image forming apparatus, and more particularly, to a system for detecting abnormalities which are liable to occur in an image forming apparatus and for judging the kind of abnormalities which have occurred.

2. Description of the Related Arts

According to an electrophotographic method, an electrostatic latent image formed on the surface of a photosensitive member is developed using toner contained in a two-component developer consisting of toner and carrier. A toner image is then transferred onto a paper sheet and fixed on the paper sheet.

A copying machine, a page printer and the like are provided as an image forming apparatus utilizing the electrophotographic method.

In order to optimize the quality of a reproduced image by controlling a developing process in the image forming apparatus, it is necessary to maintain the toner density, namely, the ratio between toner and carrier in the vicinity of a predetermined value.

To this end, a feedback control is performed by providing a toner density sensor in the vicinity of a developing unit so that the toner density sensor detects the density of toner accommodated in the developing unit.

A sensor for detecting the permeability of a two-component developer accommodated in the developing unit is widely used.

In an image forming operation, the two-component developer is regularly agitated and transported by a screw roller or rollers mounted in the developing unit so that the density of the two-component developer may be uniform. Therefore, a value detected by the toner density sensor corresponds to the value of the density of entire two-component developer accommodated in the developing unit.

The developing unit is often removed from the image forming apparatus for its maintenance and inspection, or for replacement of developer in the same color or in a different color.

When the developing unit is replaced with a new one, the toner density sensor is replaced as well because the toner density sensor is fixed to the developing unit. Therefore, it is necessary to check whether or not the toner density sensor is normal whenever the toner density sensor is replaced. This is because, as described above, the toner density sensor plays an important part in performing an image forming operation.

There is an increased demand for the development of a system capable of easily checking the abnormality of the toner density sensor.

Furthermore, when the developing unit is removed from the image forming apparatus, it is likely that a mechanism for transmitting the driving force to the screw rollers is damaged.

There is also an increased demand for the development of a system capable of promptly detecting a portion of the mechanism in which an abnormality has occurred.

Only the installation of a sensor or sensors for detecting the drive condition of the driving force transmission mechanism is not enough to accurately judge whether the abnormality has occurred in the driving force transmission mechanism or in the sensors.

The sensors occasionally become abnormal when the sensors are soiled by magnetic toner contained in the image forming apparatus.

SUMMARY OF THE INVENTION

Accordingly, an object of the present invention is to provide a system for accurately detecting abnormalities which might occur in an image forming apparatus.

Another object of the present invention is to provide a system of the above-described type which is capable of judging the kind of abnormalities which have occurred in the image forming apparatus.

In order to accomplish the above-described objects, an image forming apparatus, to which the present invention is applied, is provided with a developing unit accommodating developer consisting of toner and carrier, agitating means for agitating the developer accommodated in the developing unit, pulsation detecting means for detecting pulsation of the developer caused by the agitating means, comparing means for comparing the cycle of the pulsation detected by the pulsation detecting means and that of agitation caused by the agitating means with each other, and abnormal signal output means for outputting a signal indicative of an abnormality of the apparatus based on a result obtained by the comparing means.

In another aspect of the present invention, an image forming apparatus includes a developing unit accommodating the developer, agitating means for regularly agitating the developer accommodated in the developing unit, density detecting means for detecting the density of the developer accommodated in the developing unit, judging means for judging whether or not fluctuation of an output value of the density detecting means is regular, and abnormal signal output means for outputting a signal indicative of an abnormality of the apparatus based on a result obtained by the judging means.

In still another aspect of the present invention, an image forming apparatus includes a developing unit accommodating the developer, agitating means for regularly agitating the developer accommodated in the developing unit, permeability detecting means for detecting a permeability of the developer accommodated in the developing unit, judging means for judging whether or not fluctuation of an output value of the permeability detecting means is regular, and abnormal signal output means for outputting a signal indicative of an abnormality of the apparatus based on a result obtained by the judging means.

In a further aspect of the present invention, an image forming apparatus includes a developing unit accommodating the developer, agitating means for regularly agitating the developer accommodated in the developing unit, output means for outputting a signal to be used to drive the agitating means, permeability detecting means for detecting a permeability of the developer accommodated in the developing unit, judging means for judging whether or not fluctuation of an output value of the permeability detecting means is regular when the signal for driving the agitating means is outputted, and abnormal signal output means for outputting a signal indicative of an abnormality of the apparatus based on a result obtained by the judging means.

In a still further aspect of the present invention, an image forming apparatus includes a developing unit accommodating the developer, agitating means for regularly agitating the developer accommodated in the developing unit, a driving source for driving the agitating means, output means for outputting a signal to be used to drive the driving source, transmitting means for transmitting the driving force from the driving source to the agitating means, transmitting condition detecting means for detecting the transmitting condition of the driving force at at least one location of the transmitting means, permeability detecting means for detecting the permeability of the developer accommodated in the developing unit, fluctuation detecting means for detecting regular fluctuation of an output value of the permeability detecting means, and specifying means for specifying a location at which an abnormality has occurred based on the signal for driving the driving source, a signal outputted from the transmitting condition detecting means, and a signal outputted from the fluctuation detecting means.

The present invention is based upon investigation conducted by the applicant of the instant application with respect to a signal detected by a toner density sensor.

More specifically, the applicant has discovered that this signal regularly pulsates in a predetermined cycle.

The reason for this is that since two-component developer is regularly agitated and transported by screw rollers mounted in the developing unit, the permeability of developer detected by the toner density sensor regularly changes.

This means that the period of pulsation of the permeability coincides with that of rotation of the screw rollers and is in a certain relationship, determined by the gear ratio of a driving force transmission mechanism, with that of rotation of a driving source.

It is, therefore, considered that whether or not the toner density sensor is normal can be easily checked by comparing the period of pulsation of the permeability with the operating condition of the driving force transmission mechanism.

Furthermore, it is possible to judge whether an abnormality has occurred in the driving force transmission mechanism or in sensors for detecting the operating condition thereof and to specify the position where the abnormality has occurred.

BRIEF DESCRIPTION OF THE DRAWINGS

These and other objects and features of the present invention will become clear from the following description taken in conjunction with the preferred embodiment thereof with reference to the accompanying drawings, throughout which like parts are designated by like reference numerals, and wherein.

DETAILED DESCRIPTION OF THE EMBODIMENTS

Outline of Mechanism of Copying Apparatus

Figure 2:
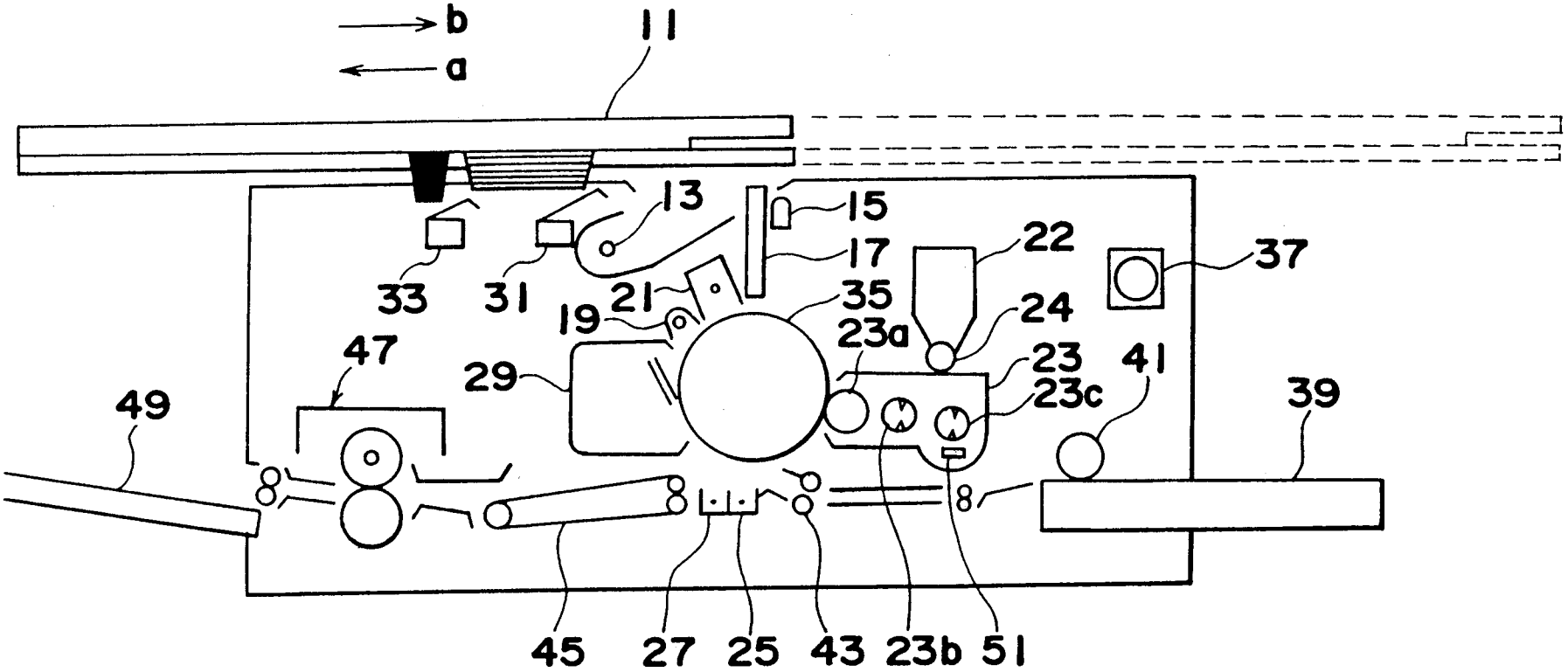
FIG. 2 is a schematic sectional view of the copying apparatus provided with the control circuit of FIG. 1.

FIG. 2 schematically depicts a copying apparatus to which the present invention is applied. The copying apparatus of FIG. 2 is a copying apparatus of the type having a movable document platform, on which an original document is placed, and comprising a scanning optical system, an image forming system, and a sheet processing system.

Scanning Optical System

The scanning optical system comprises a document platform 11 with a cover, an exposure lamp 11 for emitting light to the surface of an original document, a lens assembly 17 including a series of lenses for introducing light reflected by the surface of the original document to a photosensitive drum 35 of the image forming system, and a light receiving element 15 for detecting the intensity of the light reflected by the surface of the original document.

At the time of scanning, the document platform 11 initially moves in the direction shown by an arrow (a), thus returning to its start position. The return of the document platform 11 to the start position is detected by a switch 33 disposed below the document platform 11.

The document platform 11 then starts moving in the direction shown by an arrow (b), thus performing the scanning of the original document. In this event, a register switch 31 disposed adjacent to the switch 33 sends a signal to the image forming system so that the system can start an image forming process. Thereafter, a signal sent from the image forming system causes the document platform 11 to move in the direction shown by the arrow (a) to return to its original position.

Image Forming System

The image forming system includes a photosensitive drum 35 for forming an electrostatic latent image in response to light reflected by the original document and guided thereto through the lens assembly 17.

Around the photosensitive drum 35 are disposed a charger 21 for uniformly charging the surface of the photosensitive drum 35, a developing unit 23 for developing an electrostatic latent image formed on the surface of the photosensitive drum 35 into a toner image, a transfer charger 25 for transferring the toner image formed on the photosensitive drum 35 to a paper sheet, a separation charger 27 for separating from the photosensitive drum 35 the paper sheet to which the toner image has been transferred, a cleaning unit for removing toner remaining on the surface of the photosensitive drum 35, and an erasing lamp 19 for erasing the residual charge on the surface of the photosensitive drum 35.

A toner hopper 22 is disposed above the developing unit 23. Toner accommodated in the toner hopper 22 are supplied to the developing unit 23 by a toner supply motor 24.

Figure 3:
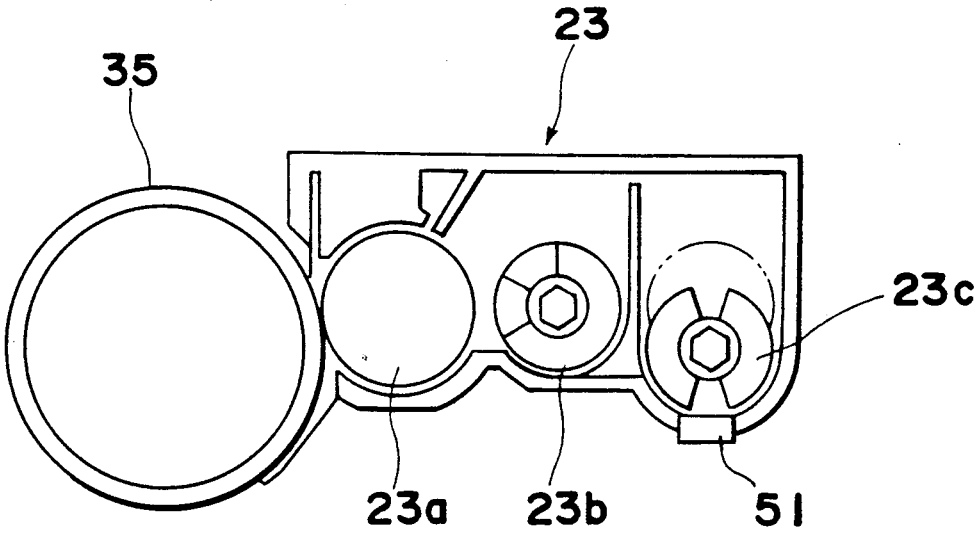
FIG. 3 is a schematic sectional view of a developing unit provided in the copying apparatus of FIG. 2.
Figure 4:
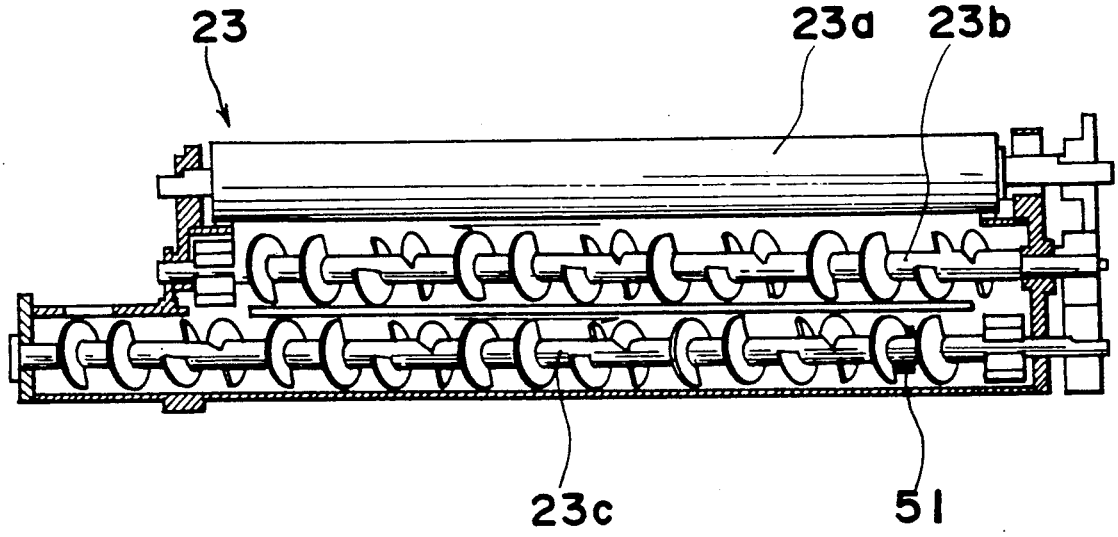
FIG. 4 is a top plan view of a developing sleeve and screw rollers provided in the developing unit of FIG. 3.

As shown in FIGS. 3 and 4, there are provided in the developing unit 23 a developing sleeve 23*a* and screw rollers 23*b* and 23*c* driven by a main motor 37. Toner supplied by the toner hopper 22 are transported from the left side toward the right side of the screw roller 23*c* as viewed in FIG. 4, and then transported to the screw roller 23*b*. Thereafter, the toner is transported from the right side toward the left side of the screw roller 23*b* as viewed in FIG. 4. Thus, the toner is circulated by the screw rollers 23*c* and 23*b* in the developing unit 23. While the toner is transported by the screw roller 23*b*, part thereof moves from the screw roller 23*b* to the surface of the developing sleeve 23*a*.

A toner density detecting sensor 51 (hereinafter referred to as toner density sensor) positioned below the screw roller 23*c* detects the permeability of two-component developer consisting of toner and carrier in the form of the ratio between the toner and the carrier. As described above, the developer accommodated in the developing unit 23 is transported toward the photosensitive drum 35 by the screw rollers 23*b* and 23*c*. Therefore, the permeability of the developer detected by the toner density sensor 51 pulsates as described later.

Sheet Processing System

The sheet processing system effects supply and transportation of the paper sheet, fixation of the toner image, and discharge of the paper sheet.

More specifically, the paper sheet discharged from a sheet cassette 39 by a supply roller 41 is stopped by a pair of register rollers 43 and then, transported to a region between the photosensitive drum 35 and the transfer charger 25 so that the toner image formed on the surface of the photosensitive drum 35 may be transferred therefrom to the paper sheet.

The paper sheet is then separated from the photosensitive drum 35 by the separation charger 27 and transported by a transporting belt 45 to a fixing unit 47 so that the toner image may be fixed on the paper sheet. Thereafter, the paper sheet is discharged to a discharge tray 49.

Driving Force Transmission Mechanism of Main Motor

Figure 5:
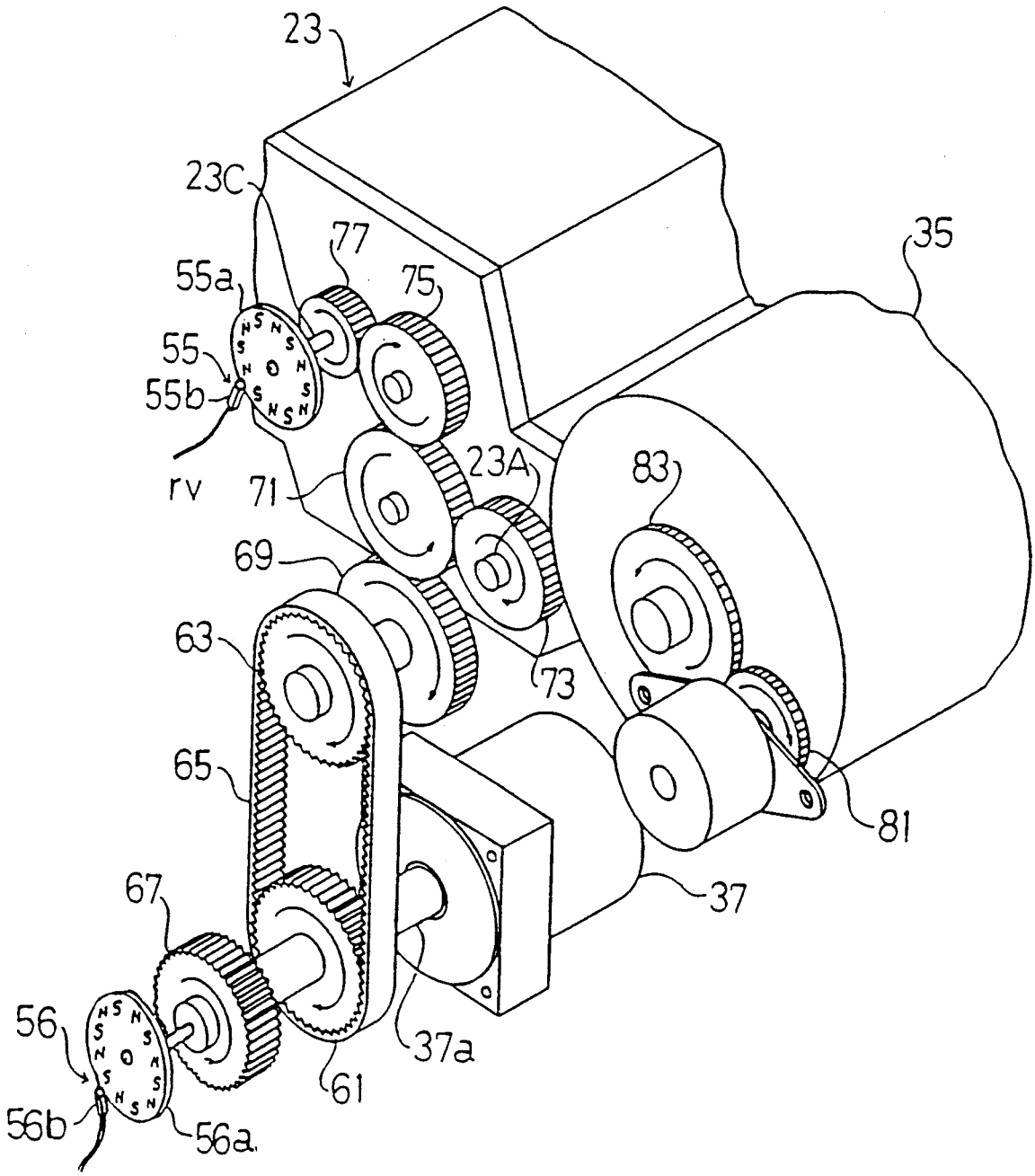
FIG. 5 is a perspective view of a driving force transmitting mechanism of the developing unit of FIG. 3.

FIG. 5 depicts a driving force transmission mechanism of the main motor 37. Pulleys 61 and 67 are concentrically mounted on an output shaft 37*a* of the main motor 37.

The pulley 61 is connected to a pulley 63 through a timing belt 65. The pulley 63 rotates together with a docking gear 69. A bucket gear 71 engages with the docking gear 69. The bucket gear 71 engages with an idle gear 75 and a sleeve gear 73 which rotates together with a screw shaft 23A. The idle gear 75 engages with a screw gear 77 which rotates together with a screw shaft 23C. Thus, the rotation of the main motor 37 is transmitted to the screw shaft 23C.

A magnet rotary disk 55*a* is fixed to the screw shaft 23C. The rotation of the magnet rotary disk 55*a* is detected by a Hall element 55*b* positioned in the vicinity thereof, which generates a signal Vl shown in FIG. 1, which is described later. That is, the rotation speed detecting unit of the screw roller 23*c* comprises the magnet rotary disk 55*a* and the Hall element 55*b*.

The pulley 67 is connected to a gear 83 which rotates together with a shaft of the photosensitive drum 35 through a driving force transmission mechanism (not shown) and a gear 81.

Similarly, a magnet rotary disk 56*a* is mounted on the output shaft 37*a* of the main motor 37. A Hall element 56*b* positioned in the vicinity of the magnet rotary disk 56*a* detects the rotation thereof. Thus, the rotation speed detecting unit of the main motor 37 comprises the magnet rotary disk 56*a* and the Hall element 56*b*. When the Hall element 56*b* detects the rotation of the magnet rotary disk 56*a*, it generates a signal Vh shown in FIG. 1.

Construction of Control Circuit

Figure 1:
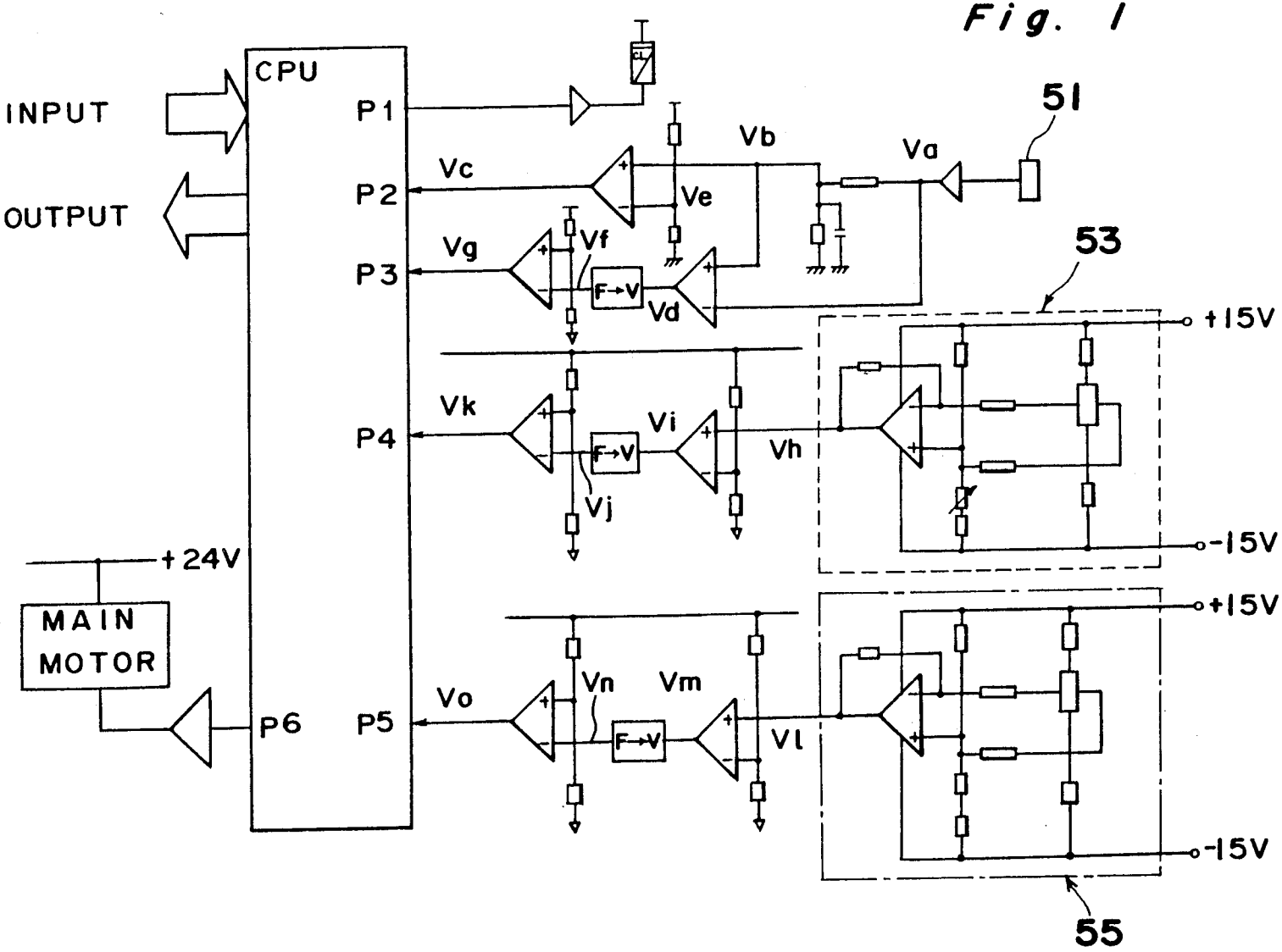
FIG. 1 is a block diagram of a control circuit of a copying apparatus provided with an abnormality detecting system according to the present invention.

FIG. 1 is a block diagram showing the construction of a control circuit of the copying apparatus. FIGS. 6 through 9 show the conditions of signals shown in FIG. 1.

The following signals are inputted into input ports of a CPU provided in the control circuit:

- Port P2: a signal Vc outputted from the toner density sensor 51 and requesting toner supply when the signal level is low.
- Port P3: a signal Vg indicating that the output of the toner density sensor 51 is pulsating when the signal level is low.
- Port P4: a signal Vk indicating that the main motor 37 is rotating when the signal level is low.
- Port P5: a signal Vo indicating that the screw roller 23*c* is rotating when the signal level is low.

A signal for controlling the main motor 37 (hereinafter referred to as drive signal) is outputted from an output port P6. When the signal level is low, the drive signal is supplied to the main motor 37.

Signals other than the above-described signals will also be explained hereinafter.

Figure 6:
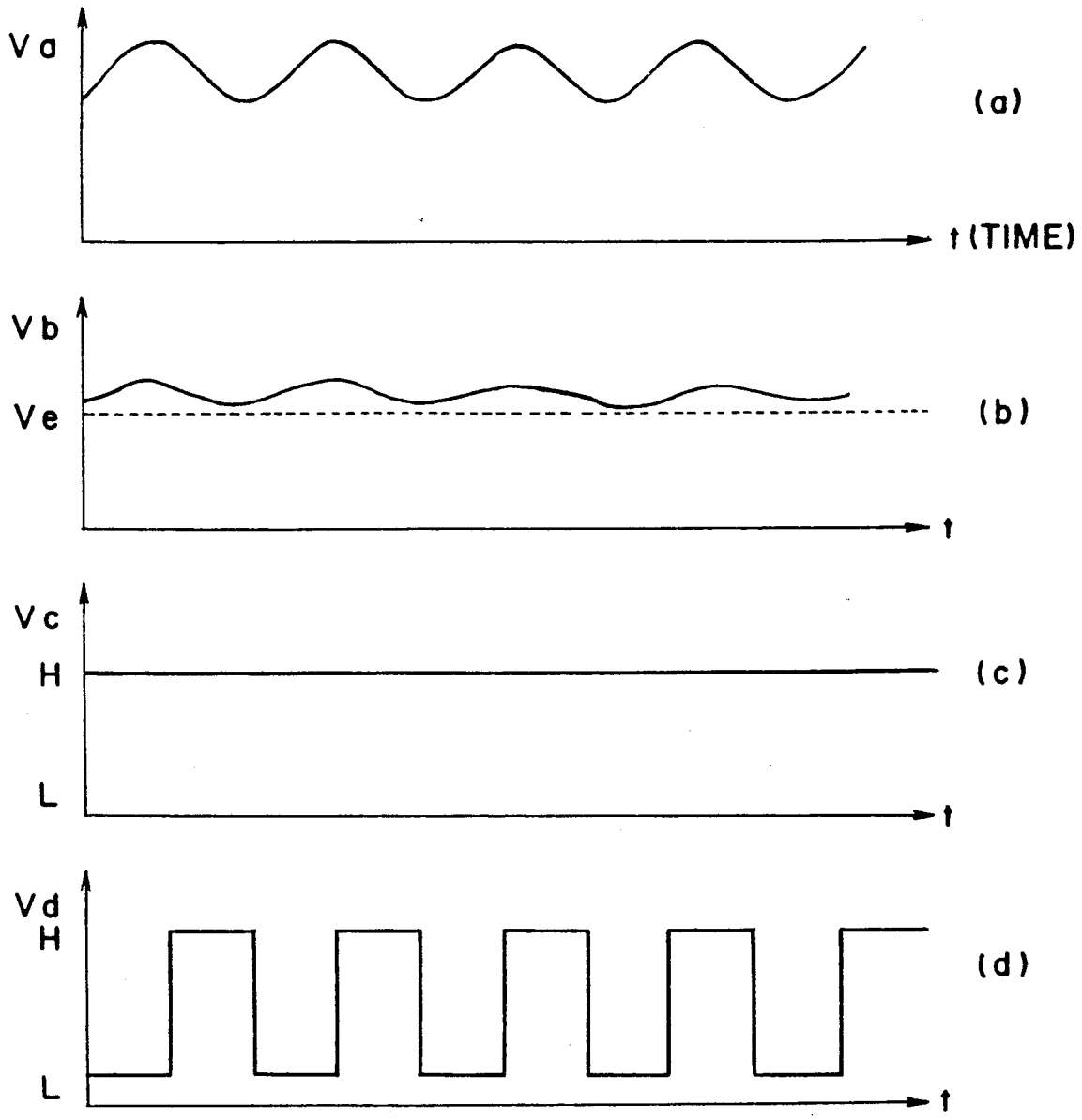
FIG. 6 shows waveform diagrams of signals Va through Ve in the control circuit of FIG. 1 when an output of a toner density sensor provided in the developing unit of FIG. 3 pulsates.
Figure 7:
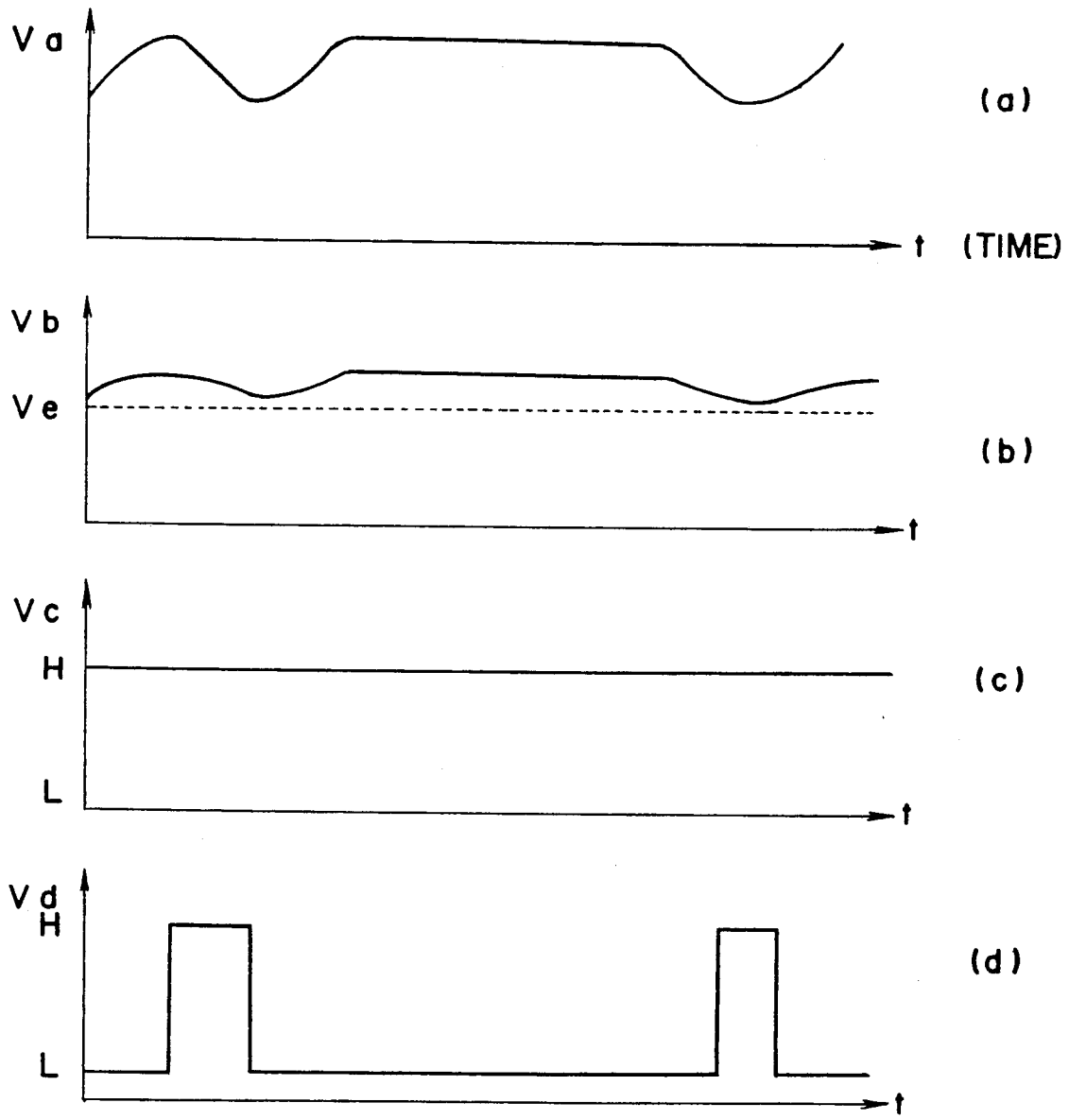
FIG. 7 shows waveform diagrams similar to those of FIG. 6, when the output of the toner density sensor does not pulsate.

FIG. 6 shows waveforms of signals Va through Ve shown in FIG. 1 at the time when the output of the toner density sensor 51 is pulsating. FIG. 7 also shows the waveforms of the signals Va through Ve at the time when the pulsation of the output of the toner density sensor 51 is stopped for a while. Reference characters (a), (b), (c), and (d) of FIG. 6 correspond to reference characters (a), (b), (c), and (d) of FIG. 7.

(i) Signal Vc (refer to FIGS. 6 and 7)

An output signal Va of the toner density sensor 51 indicates the permeability of developer and is in proportion to the toner density. The signal Va pulsates as shown by (a) of FIG. 6 by the influence of the rotation of the screw roller 23*c*. Therefore, the signal Va is smoothed by a low-pass filter (CR circuit) and converted into a signal Vb as shown by (b) of FIG. 6. A comparator compares the signal Vb with a reference value Ve, thus outputting a signal Vc (hereinafter referred to as density signal) indicating the toner density.

The reference value Ve is so selected that the value of the density signal Vc becomes a low level when the amount of the toner is insufficient. When the level of the density signal Vc becomes low, the CPU outputs a signal for requesting toner supply to drive the toner supply motor 24.

Figure 9:
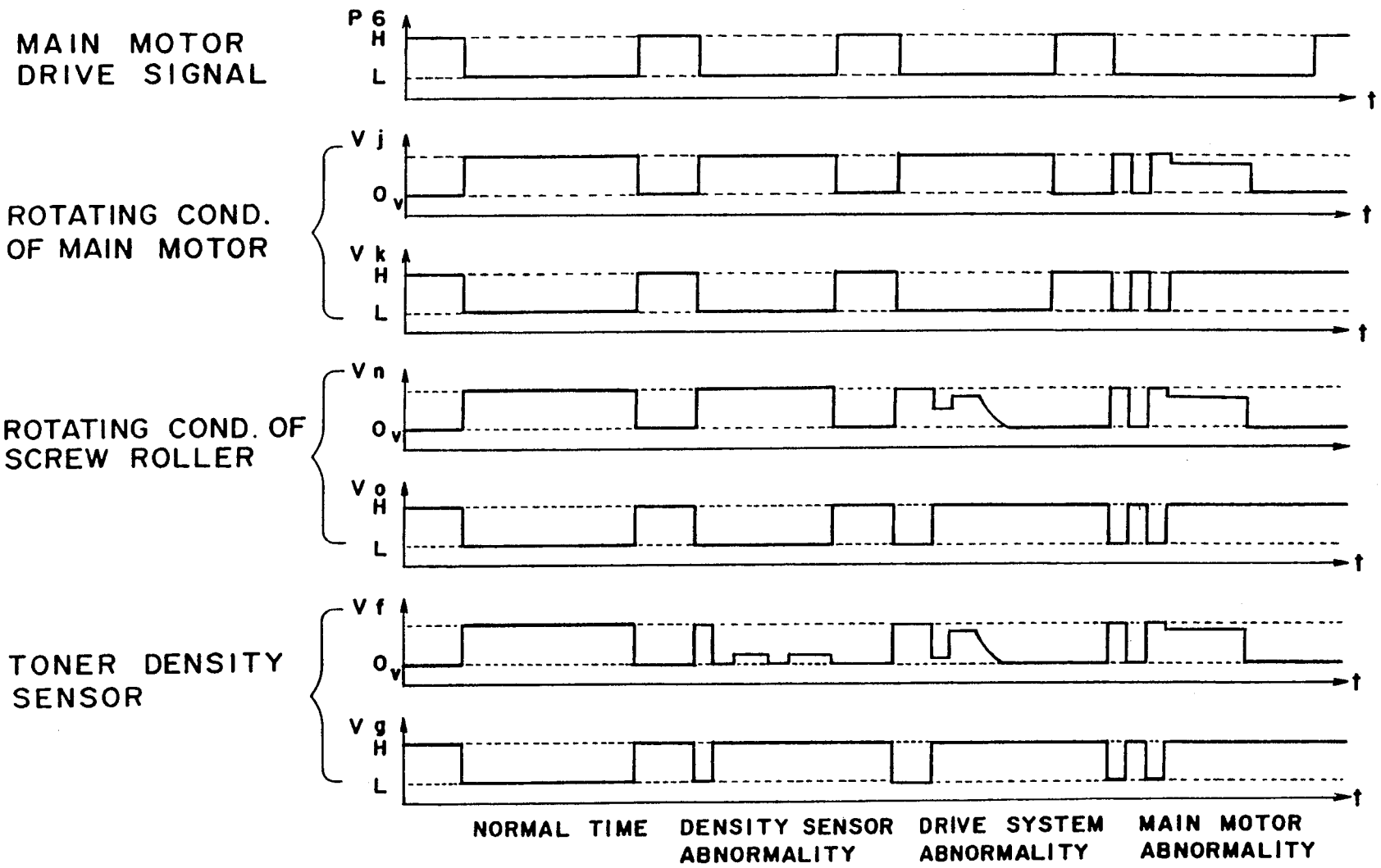
FIG. 9 shows waveform diagrams showing a criterion for judging whether or not an abnormality has occurred based on a signal for driving a main motor, the rotating condition of the main motor, the rotating condition of screw rollers, and the output condition of the toner density sensor.

(ii) Signal Vg (refer to FIGS. 6, 7, and 9)

A comparator compares the signal Va outputted from the toner density sensor 51 and the signal Vb generated by smoothing the signal Va with each other. As a result, the comparator outputs a pulse signal Vd having the same frequency as the signal Va which is pulsating. Next, the pulse signal Vd is converted into an analog voltage signal Vf, which is proportional to the above frequency. A comparator compares the signal Vf with a reference value, thus outputting a signal Vg.

As understood from the above, when the signal Va outputted from the toner density sensor 51 does not pulsate, the value of the signal Vf is reduced. Consequently, the level of the signal Vg becomes high.

Figure 8:
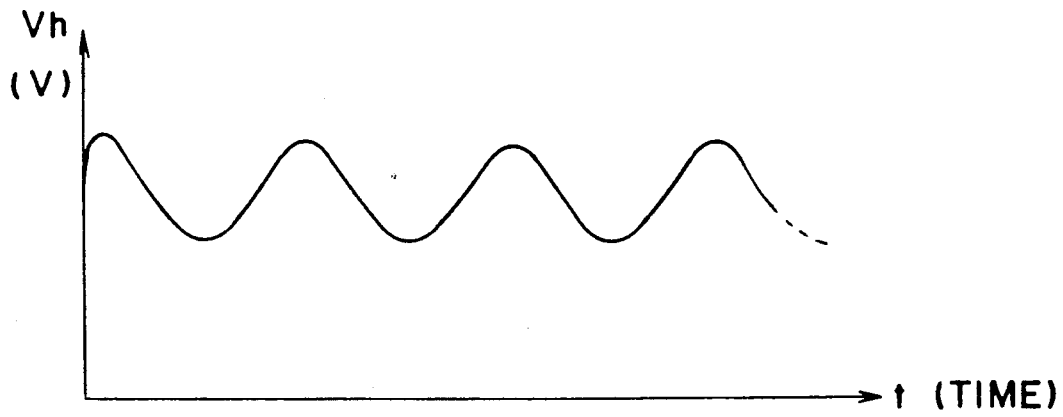
FIG. 8 shows waveform diagrams of output signals Vh and Vi of a motor rotation detecting sensor provided in the driving force transmitting mechanism of FIG. 5.
Figure 8:
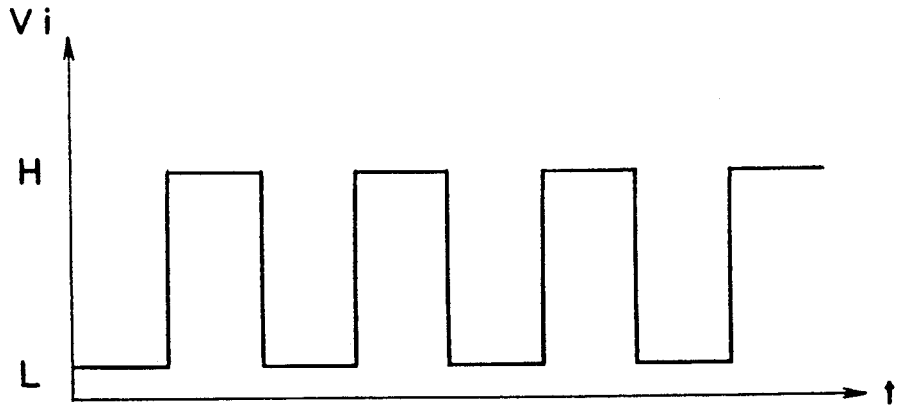

(iii) Signal Vk (refer to FIGS. 8 and 9)

First, a signal Vh outputted from the rotation speed detecting means 53 of the main motor 37 is converted by a comparator into a pulse signal Vi, the frequency of which is identical to that of the signal Vh. Next, the pulse signal Vi is converted into an analog voltage signal Vj, which is proportional to the above frequency. The comparator compares the signal Vj with a reference value, thus outputting a signal Vk.

As understood from the above, when the value of the analog voltage signal Vj becomes lower than the reference value as a result of the reduced rotational speed of the main motor 37, the level of the signal Vk becomes high.

(iv) Signal Vo (refer to FIG. 9)

First, a signal Vl outputted from the rotation speed detecting means 55 of the screw roller 23*c* is converted by a comparator into a pulse signal Vm, the frequency of which is identical to that of the signal Vl. Next, the pulse signal Vm is converted into an analog voltage signal Vn, which is proportional to the above frequency. A comparator compares the signal Vn with a reference value, thus outputting a signal Vo.

As understood from the above, when the value of the analog voltage signal Vj becomes lower than the reference value as a result of the reduced rotational speed of the screw roller 23*c*, the level of the signal Vo becomes high.

As described later with reference to FIG. 12, whether or not an abnormality has occurred is decided in an abnormality detecting processing based on the conditions of the signals Vg, Vk, Vo, and the drive signal.

Processing to be executed by CPU

The operation of the apparatus, to which the present invention is applied, will be described with reference to the processing of the CPU.

(1) Main routine

Figure 10:
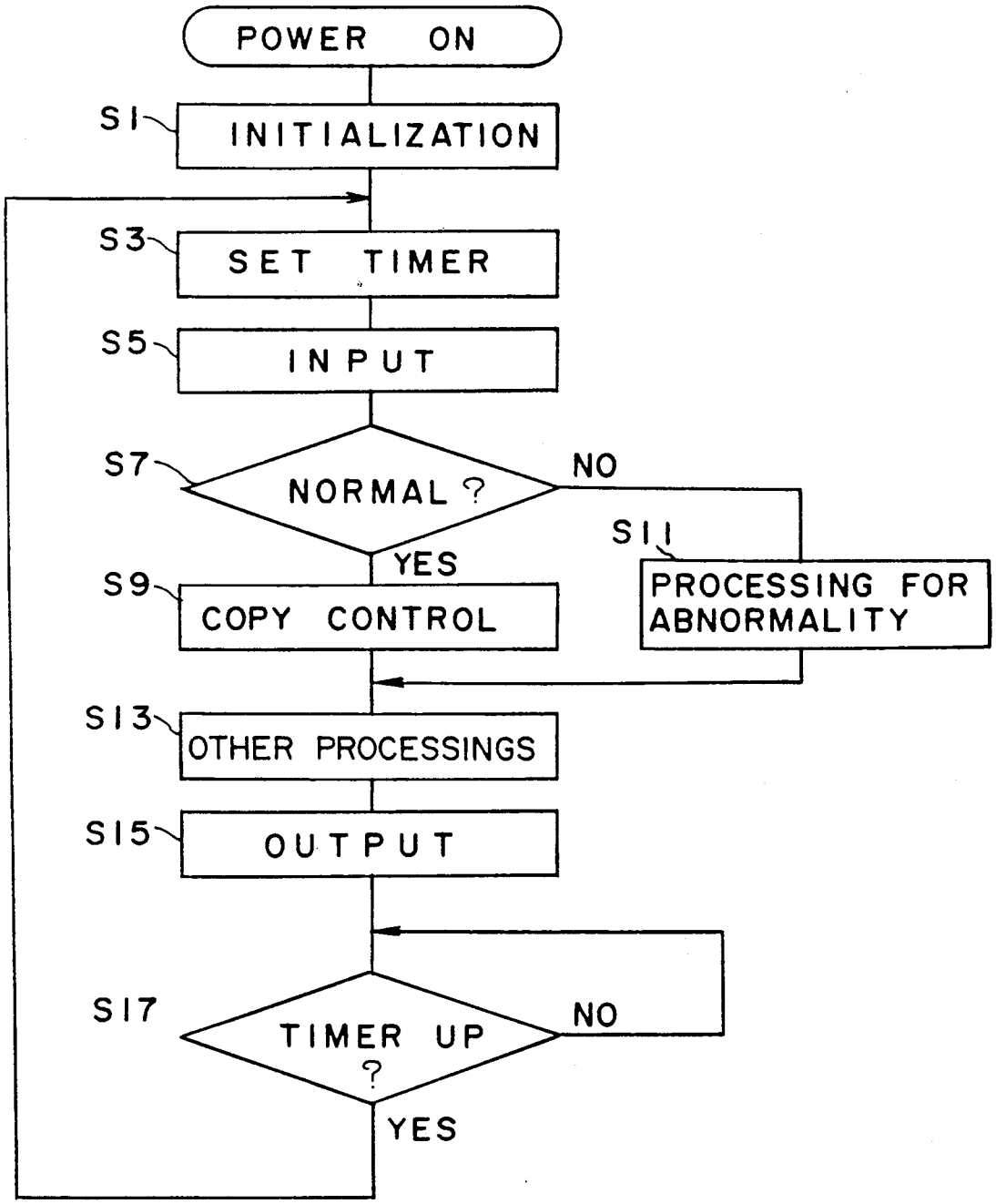
FIG. 10 is a flowchart showing the main routine of the processing to be executed in a CPU provided in the control circuit of FIG. 1.

FIG. 10 is a flowchart showing the main routine of the processing to be executed by the CPU.

At step S1, the CPU starts a processing after the power source is turned on, thus executing the initialization.

An internal timer which determines the execution period of time of on routine starts at step S3 followed by step S5, at which input processings of signals are executed.

At step S7, it is detected whether or not an abnormality has occurred. If normal, at step S9, a copy control processing is executed. If abnormal, at step S11, a processing for removing the abnormality is executed. The copy control processing to be executed at step S9 is described in detail later.

At step S13, processings other than those described above are executed by the CPU. For example, a processing for detecting jamming, that for display data, and that for counting a control timer are executed.

At step S15, the output processing of a control signal or the like is executed.

It is judged at step S17 whether or not the internal timer is up. When the timer is up, the program returns to step S3 so as to repeat the above-described processings to be executed at steps S3 through step S17.

(2) Copy Control Routine

Figures 11, 11A:
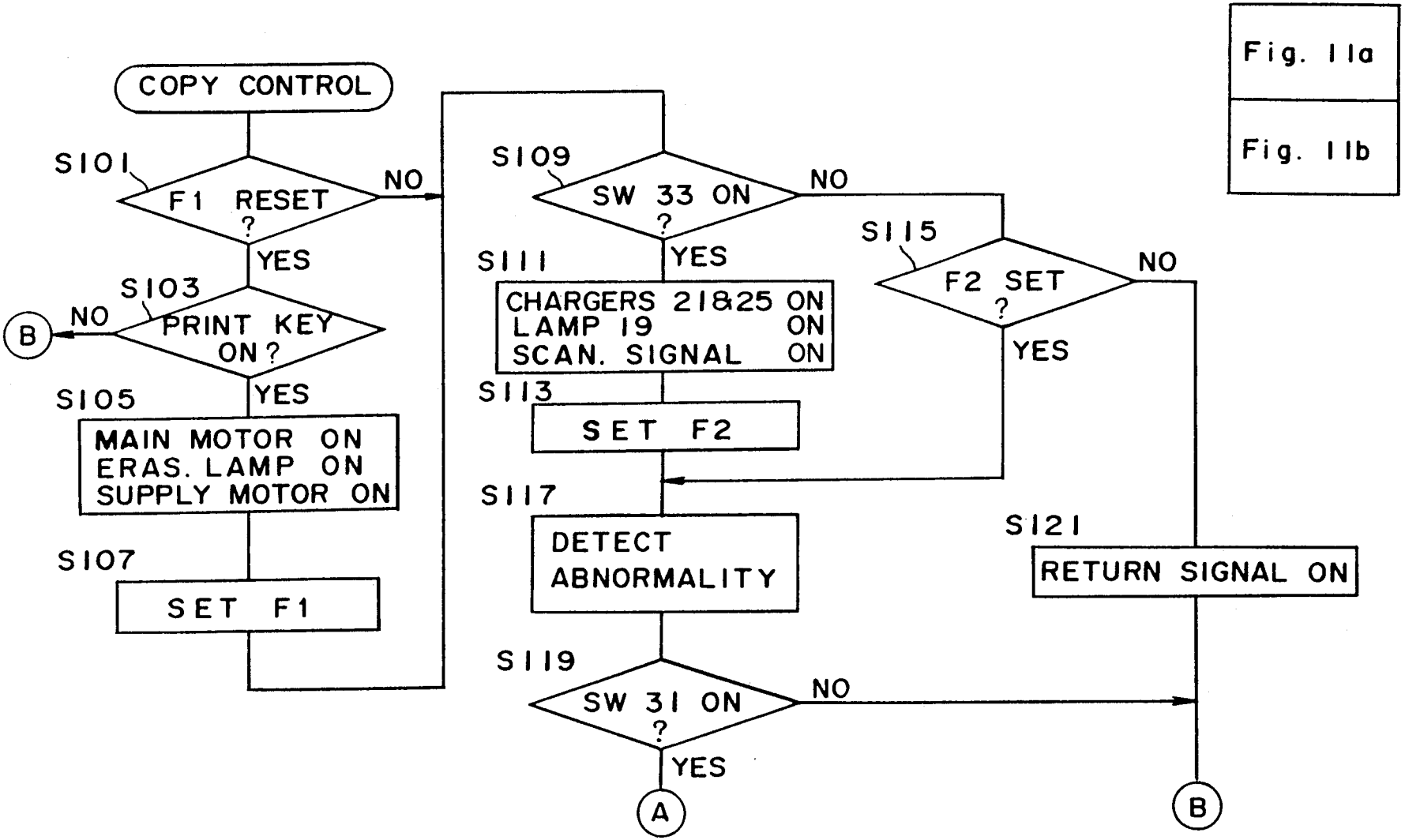
FIGS. 11*a* and 11*b* combined as shown in FIG. 11 show a flowchart showing the copy control processing to be executed at step S9 in the flowchart of FIG. 10.
Figure 11B:
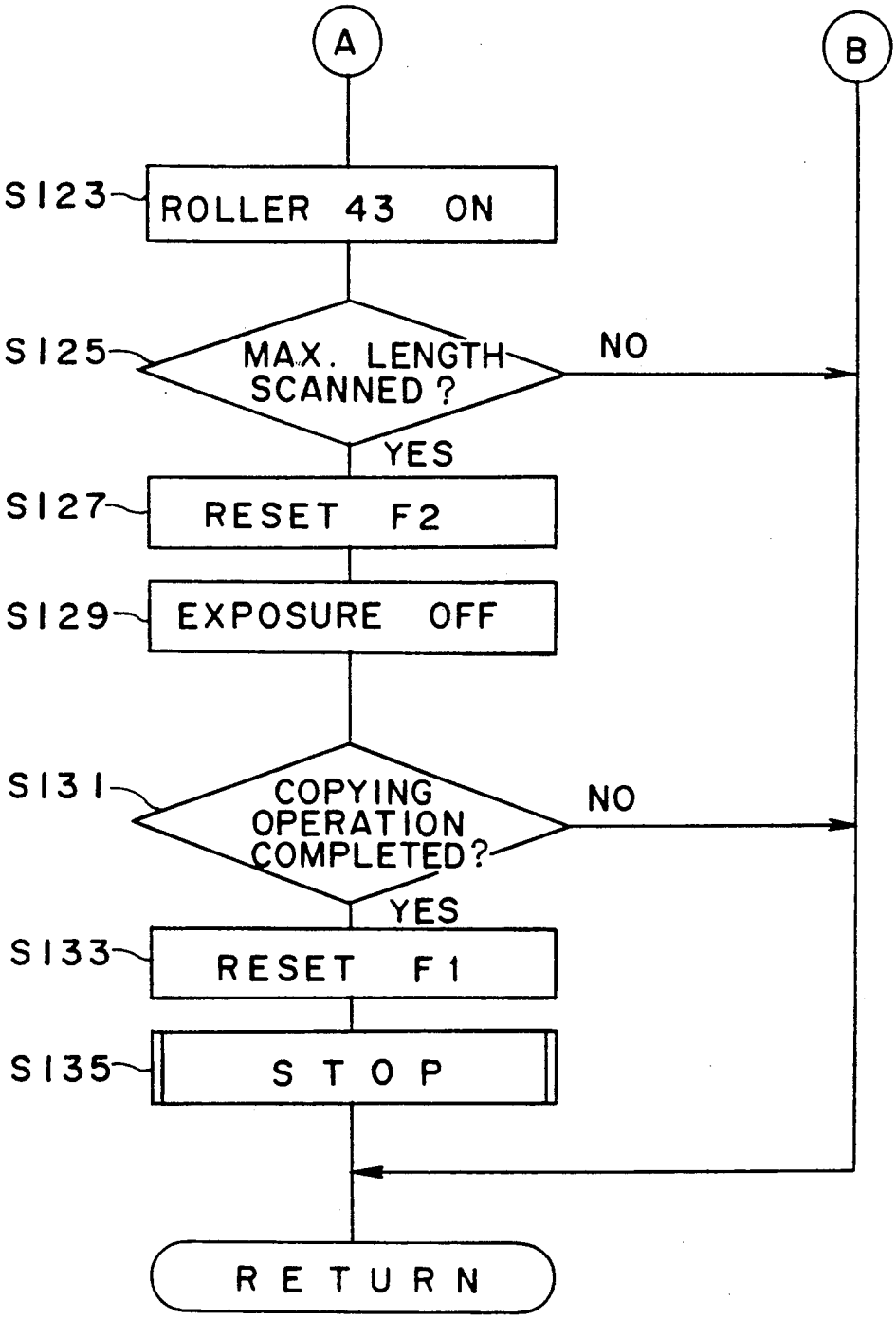

FIG. 11 is a flowchart showing the detail of the processing to be executed at step S9 (copy control routine).

(a) At the Time of Stand-by and Starting

At steps S101 through S107, the processing for starting the copying operation is executed.

More specifically, it is judged at step S101 whether or not a flag F1 is reset. If the flag F1 is on, it is judged at step S103 whether or not a print key (not shown) for starting the copying operation t is turned on. If no at step S103, the program returns to the main routine. If an ON-edge of the print key is detected at step S103, the program goes to step S105 at which the main motor 37, the erasing lamp 19, and the sheet supply motor are turned on and at step S107, the flag F1 is set. When the flag F1 is set, it signifies that the copying operation is being carried out.

(b) At the Time of Scanning

At step S109, in response to the ON-edge of the print key, the document platform 11 moves in the direction shown by the arrow (a) of FIG. 2, thus returning to the start position. The charger 21, the transfer charger 25, the erasing lamp 19, and the scanning start signal are turned on at step S111 followed by step S113, at which a flag F2 is set. When the flag F2 is set, it indicates that the scanning is being carried out.

An abnormality detecting subroutine is executed at step S117 if it is decided at step S115 that the flag F2 is set. As described below with reference to FIG. 12, the abnormality detecting subroutine is a processing for detecting whether or not the toner density sensor 51, the drive path or the main motor 37 are normal and for dealing with the abnormality according to the kind of abnormality. The processing of the abnormality detecting subroutine continues as long as the flag F2 is set.

When the scanning start signal is turned on at step S111, the document platform 11 moves in the direction shown by the arrow (b) in FIG. 2. As a result, when the register switch 31 is turned on at step S119, a clutch of the register rollers 43 is turned on at step S123. The paper sheet is then transported to a region between the photosensitive drum 35 and the transfer charger 25.

(c) At the Time of Return Operation

When the scanning of a predetermined maximum length is completed at step S125, the flag F2 is reset at step S127 followed by step S129, at which the exposure lamp 11 is turned off. When the flag F2 is reset at step S115, a return signal to be transmitted to the scanning optical system is turned on at step S121. As a result, the document platform 11 starts moving in the direction shown by the arrow (a) in FIG. 2 to return to the start position.

(d) Processing for Terminating Copying Operation

If it is decided at step S131 that the copying operation is completed by a given number, the flag F1 is reset at step S133 followed by step S135, at which the processing for terminating the copying operation is executed.

(3) Abnormality Detecting Routine

Figures 12, 12A:
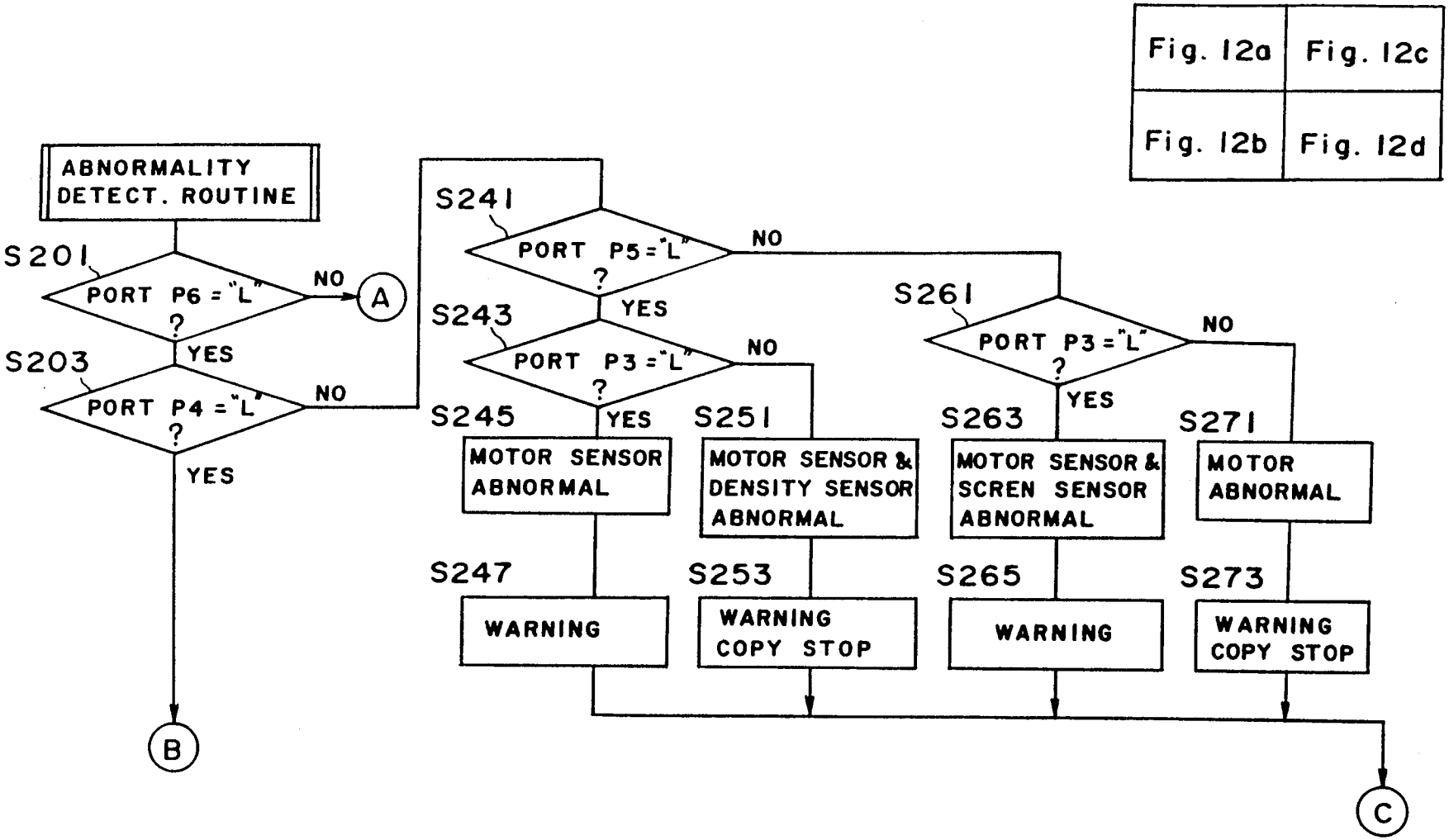
FIGS. 12*a* through 12*d* when combined as shown in FIG. 12 show a flowchart showing the abnormality detecting processing to be executed at step S117 in the flowchart of FIG. 11.
Figure 12B:
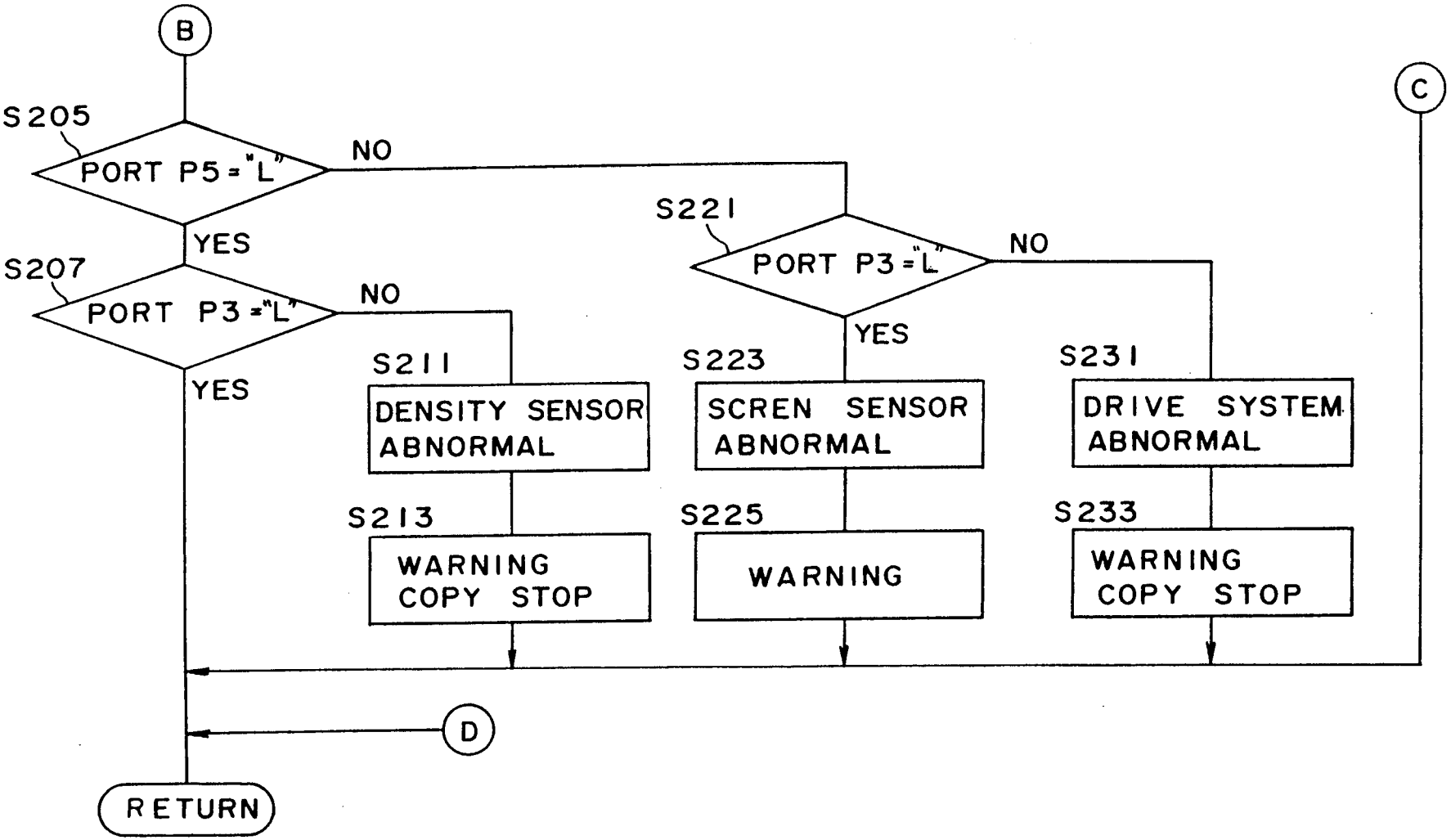
Figure 12C:
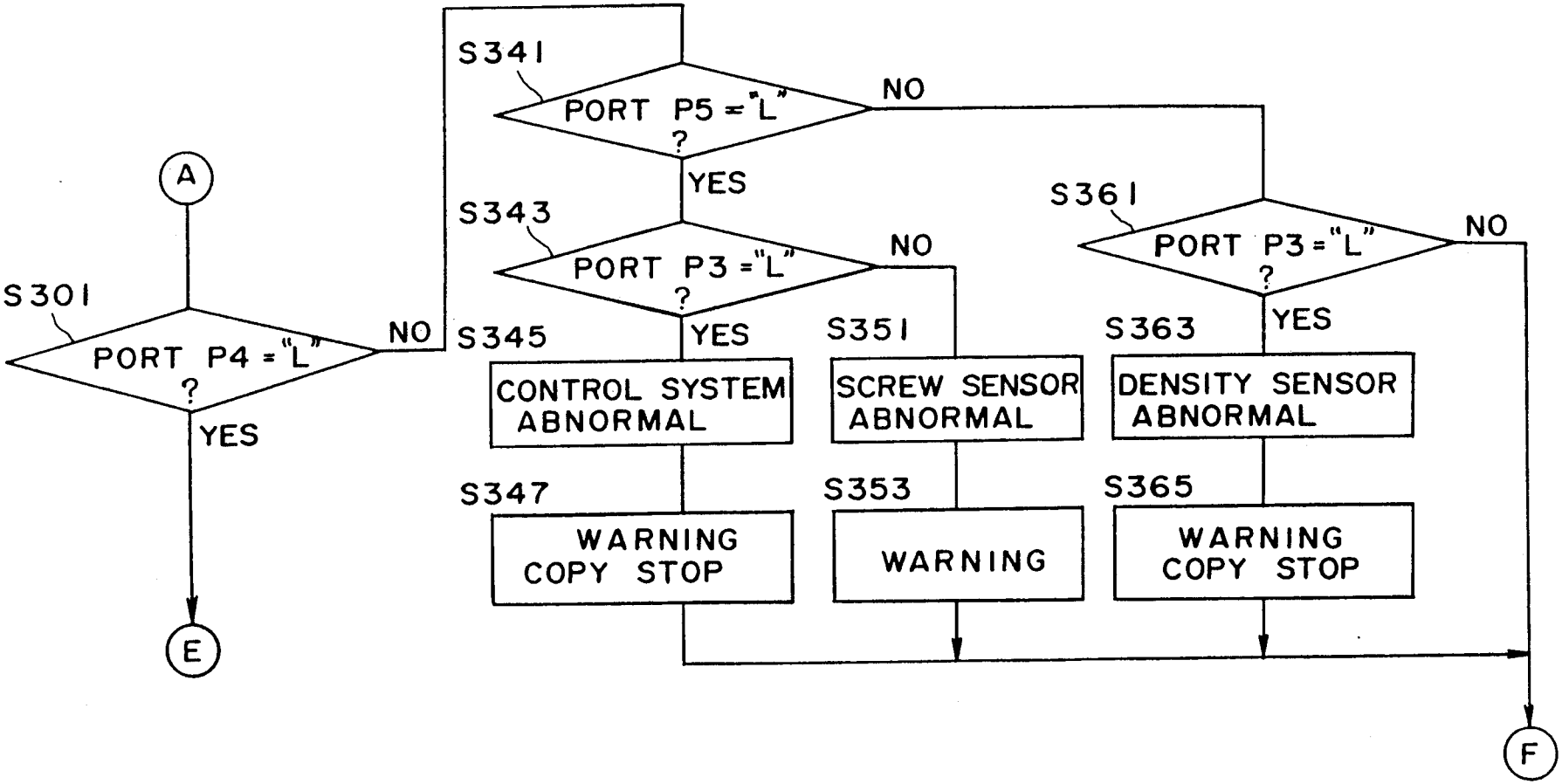
Figure 12D:
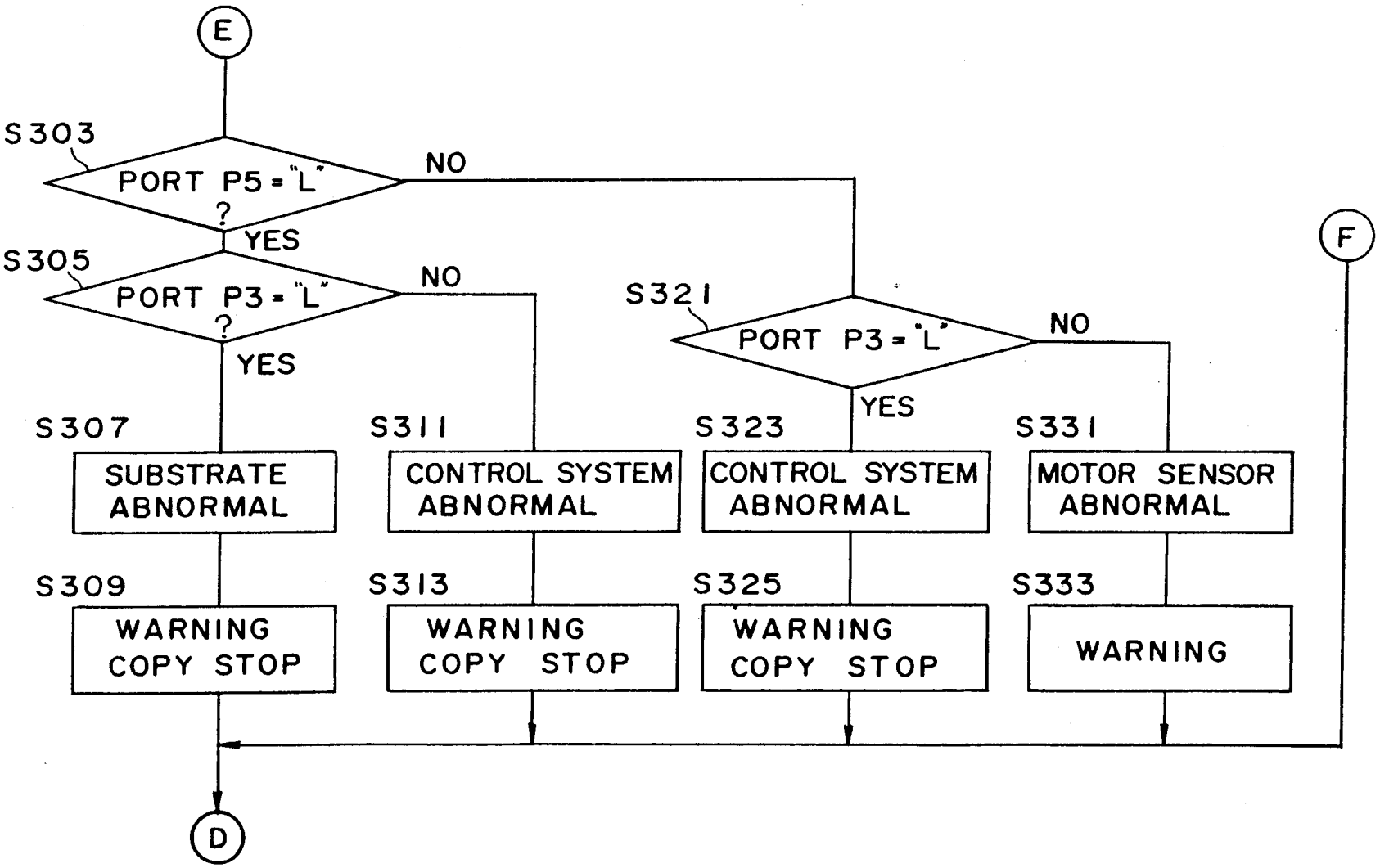

FIG. 12 is a flowchart showing the processing to be executed at step S117.

Whether or not any abnormality has occurred is decided based on the conditions of the signals Vg, Vk, Vo, and the drive signal. If an abnormality is detected, a proper processing is executed according to the kind of abnormality.

(a) Normal Time

If the signal levels are all low at the input ports P3 through P5 and the output port P6 at steps S201 through S207, it is decided that no abnormality has occurred.

This is because the drive signal supplied to the main motor 37 indicates the rotation of the main motor 37 and the screw rollers **23*b* and 23*c* and the output of the toner density sensor 51** pulsates.

(b) Abnormality of Toner Density Sensor

If the toner density sensor 51 is abnormal at step S211, a warning display is executed and the copying operation is stopped at step 213 or step 365.

The judgment of abnormality of the toner density sensor 51 results from either one of the following two cases.

(i) Only the level of the signal Vg is high and all the other signal levels are low (step S211).

This is because the main motor 37 and the screw rollers **23*b* and 23*c* rotate in the normal condition as a result of the supply of the drive signal to the main motor 37, but the output of the toner density sensor 51** does not pulsate.

(ii) Only the level of the signal Vg is low and all the other signal levels are high (step S363).

This is because the output of the toner density sensor 51 pulsates although the main motor 37 and the screw rollers **23*b* and 23*c* are out of operation because the drive signal is not supplied to the main motor 37**.

(c) Abnormality of Rotation Detector Sensor of Screw Rollers

If it is decided at step S223 that the screw rotation detecting sensor is abnormal, only a warning display is executed at step S225 or S353 because the abnormality of the screw rotation detecting sensor does not prevent the copying operation.

The judgment of abnormality of the screw rotation detecting sensor results from either one of the following two cases.

(i) Only the level of the signal Vo is high and all the other signal levels are low (step S223).

This is because the rotation of the screw rollers **23*b* and 23*c* is not detected while the drive signal is supplied to the main motor 37 and consequently, the output of the toner density sensor 51 pulsates and the main motor 37** rotates in the normal condition.

(ii) Only the level of the signal Vo is low and all the other signal levels are high (step S351).

This is because the rotation of the screw rollers **23*b* and 23*c* is detected while the output of the toner density sensor 51 does not pulsate and the main motor 37 does not rotate because the drive signal is not supplied to the main motor 37**.

(d) Abnormality of Driving System

It is decided at step S231 that the driving system for transmitting the driving force from the main motor 37 to the screw rollers **23*b* and 23*c* is abnormal, when the drive signal is supplied to the main motor 37 and the rotation of the main motor 37 is detected while the toner density sensor 51 does not pulsate nor the rotation of the screw rollers 23*b* and 23*c*** is detected.

In this case, a warning display is executed and the copying operation is stopped at step S233.

(e) Abnormality of Motor Rotation Detecting Unit

If it is decided at step S245 or step S331 that the motor rotation detecting sensor is abnormal, only a warning display is executed at step S247 or step S333 because the abnormality of the motor rotation detecting sensor does not prevent the copying operation.

In the following two cases, it is decided at step S245 or step S331 that the toner density sensor 51 is abnormal.

(i) Only the level of the signal Vk is high and all the other signal levels are low (step S245).

This is because the rotation of the main motor 37 is not detected although the output of the toner density sensor 51 pulsates and the screw rollers **23*b* and 23*c* rotate in the normal condition as a result of the supply of the drive signal to the main motor 37**.

(ii) Only the level of the signal Vk is low and all the other signal levels are high (step S351).

This is because the rotation of the main motor 37 is detected although the screw rollers **23*b* and 23*c* does not rotate nor the output of the toner density sensor 51 pulsate because the drive signal is not supplied to the main motor 37**.

(f) Abnormalities of Motor Rotation Detecting Sensor and Toner Density Sensor

In the following case, it is decided at step S251 that both the motor rotation detecting sensor and the toner density sensor 51 are abnormal: The rotation of the main motor 37 is not detected although the drive signal is supplied to the main motor 37, and the output of the toner density sensor 51 does not pulsate although the rotation of the screw rollers **23*b* and 23*c*** is detected.

In this case, at step S253, a warning display is executed and the copying operation is stopped.

(g) Abnormalities of Motor Rotation Detecting Sensor and Screw Rotation Detecting Sensor In the following case, it is decided at step S263 that both the motor rotation detecting sensor and the screw rotation detecting sensor are abnormal: The rotation of the main motor 37 is not detected although the drive signal is supplied to the main motor 37, and the output of the toner density sensor 51 pulsates although the rotation of the screw rollers 23*b* and 23*c* is not detected.

In this case, at step S265, only a warning display is executed and the copying operation is not stopped because the abnormalities of the motor rotation detecting sensor and the screw rotation detecting sensor do not prevent the copying operation.

(h) Abnormality of Motor

In the following case, it is decided at step S271 that the main motor 37 is abnormal: The rotation of the main motor 37 and the screw rollers 23*b* and 23*c* is not detected nor the toner density sensor 51 pulsates although the drive signal is outputted to the main motor 37.

In this case, at step S273, a warning display is executed and the copying operation is stopped.

(i) Abnormality of Motor Control Substrate

In the following case, it is decided at step S307 that a motor control substrate is abnormal: The rotation of the main motor 37 and the screw rollers 23*b* and 23*c* is detected and the toner density sensor 51 pulsates although the drive signal is not supplied to the main motor 37.

In this case, at step S309, a warning display is executed and the copying operation is stopped.

(j) Abnormality of Control System

In this case, at step S313, S325, or S347, a warning display is executed and the copying operation is stopped.

In the following three cases, it is decided at step S311, S323, or S345 that the control system is abnormal.

(i) The rotation of the main motor 37 and the screw rollers 23*b* and 23*c* is detected although the drive signal is not supplied to the main motor 37 and the output of the toner density sensor 51 does not pulsate (step S311).

(ii) The rotation of the main motor 37 is detected although the drive signal is not supplied to the main motor 37 and the output of the toner density sensor 51 pulsates although the rotation of the screw rollers 23*b* and 23*c* is not detected (step S323).

(iii) The output of the toner density sensor 51 pulsates and the rotation of the screw rollers 23*b* and 23*c* is detected although the rotation of the main motor 37 is not detected because the drive signal is not supplied to the main motor 37 (step S345).

To sum up, abnormalities in the image forming apparatus can be determined based on the drive signal and the signals Vk, Vo, and Vg, as shown in Table 1.

TABLE 1

| Drive Signal | Vk | Vo | Vg | Defective Portion |
|---|---|---|---|---|
| L | L | L | L | normal |
| L | L | L | H | toner density sensor |
| L | L | H | L | screw rotation sensor |
| L | L | H | H | driving system |
| L | H | L | L | motor rotation sensor |
| L | H | L | H | motor rotation sensor toner density sensor |
| L | H | H | L | motor rotation sensor screw rotation sensor |
| L | H | H | H | main motor |
| H | L | L | L | motor control substrate |
| H | L | L | H | control system |
| H | L | H | L | control system |
| H | L | H | H | motor rotation sensor |
| H | H | L | L | control system |
| H | H | L | H | screw rotation sensor |

TABLE 1-continued

| Drive Signal | Vk | Vo | Vg | Defective Portion |
|---|---|---|---|---|
| H | H | H | L | toner density sensor |
| H | H | H | H | — |

The processing in the CPU is executed as described above so as to make a decision as to whether or not an abnormality has occurred. If the abnormality has occurred, the kind of abnormality is determined and the processing for removing the abnormality is executed.

As apparent from the foregoing description, the abnormality of the toner density sensor can be easily detected by comparing the drive control signal and the pulsation of a value indicative of the toner density detected by the toner density sensor with each other.

Furthermore, according to the present invention, whether the sensors or the driving system is abnormal or which portion is abnormal can be decided in detail by comparing the control signal supplied to the driving source or the condition in which the driving force is transmitted with the pulsation of the aforementioned value indicative of the toner density.

Therefore, the image forming operation can be carried out under proper developing conditions.

Although the present invention has been fully described by way of examples with reference to the accompanying drawings, it is to be noted that various changes and modifications will be apparent to those skilled in the art. Therefore, unless such changes and modifications otherwise depart from the spirit and scope of the present invention, they should be construed as being included therein.

What is claimed is:

1. An image forming apparatus for developing an electrostatic latent image formed on a surface of a photosensitive member into a visual image using developer, said apparatus comprising:

a developing unit accommodating the developer;

agitating means for agitating the developer accommodated in said developing unit;

pulsation detecting means for detecting pulsation of the developer caused by said agitating means;

comparing means for comparing a cycle of the pulsation detected by said pulsation detecting means and a cycle of agitation caused by said agitating means with each other; and abnormal signal output means for outputting a signal indicative of an abnormality of the apparatus based on a result obtained by said comparing means.

2. The apparatus according to claim 1, wherein the developer consists of toner and carrier.

3. The apparatus according to claim 2, wherein said pulsation detecting means comprises a permeability detecting sensor for detecting a permeability of the developer.

4. The apparatus according to claim 3, wherein said permeability detecting sensor is used to detect a density of the toner accommodated in said developing unit.

5. An image forming apparatus for developing an electrostatic latent image formed on a surface of a photosensitive member into a visual image using developer, said apparatus comprising:

a developing unit accommodating the developer;

agitating means for regularly agitating the developer accommodated in said developing unit;

density detecting means for detecting a density of the developer accommodated in said developing unit;

judging means for judging whether or not fluctuation of an output value of said density detecting means is regular, said fluctuation being caused by said agitating means; and abnormal signal output means for outputting a signal indicative of an abnormality of the apparatus based on a result obtained by said judging means.

6. The apparatus according to claim 5, wherein the developer consists of toner and carrier.

7. The apparatus according to claim 6, wherein said density detecting means comprises a permeability detecting sensor for detecting a permeability of the developer.

8. The apparatus according to claim 5 further comprising warning means for giving a warning when said signal indicative of the abnormality is outputted.

9. The apparatus according to claim 8 further comprising stop means for stopping an operation of the apparatus when said signal indicative of the abnormality is outputted.

10. An image forming apparatus for developing an electrostatic latent image formed on a surface of a photosensitive member into a visual image using developer consisting of toner and carrier, said apparatus comprising:

a developing unit accommodating the developer;

agitating means for regularly agitating the developer accommodated in said developing unit;

permeability detecting means for detecting a permeability of the developer accommodated in said developing unit;

judging means for judging whether or not fluctuation of an output value of said permeability detecting means is regular, said fluctuation being caused by said agitating means; and abnormal signal output means for outputting a signal indicative of an abnormality of the apparatus based on a result obtained by said judging means.

11. The apparatus according to claim 10 further comprising warning means for giving a warning when said signal indicative of the abnormality is outputted.

12. The apparatus according to claim 11 further comprising stop means for stopping an operation of the apparatus when said signal indicative of the abnormality is outputted.

13. An image forming apparatus for developing an electrostatic latent image formed on a surface of a photosensitive member into a visual image using developer consisting of toner and carrier, said apparatus comprising:

a developing unit accommodating the developer;

agitating means for regularly agitating the developer accommodated in said developing unit;

output means for outputting a signal to be used to drive said agitating means;

permeability detecting means for detecting a permeability of the developer accommodated in said developing unit;

judging means for judging whether or not fluctuation of an output value of said permeability detecting means is regular when said signal for driving said agitating means is outputted, said fluctuation being caused by said agitating means; and abnormal signal output means for outputting a signal indicative of an abnormality of the apparatus based on a result obtained by said judging means.

14. The apparatus according to claim 13 further comprising warning means for giving a warning when said signal indicative of the abnormality is outputted.

15. An image forming apparatus for developing an electrostatic latent image formed on a surface of a photosensitive member into a visual image using developer consisting of toner and carrier, said apparatus comprising:

a developing unit accommodating the developer;

agitating means for regularly agitating the developer accommodated in said developing unit;

a driving source for driving said agitating means;

output means for outputting a signal to be used to drive said driving source;

transmitting means for transmitting a driving force from said driving source to said agitating means;

transmitting condition detecting means for detecting a transmitting condition of the driving force at at least one location of said transmitting means;

permeability detecting means for detecting a permeability of the developer accommodated in said developing unit;

fluctuation detecting means for detecting regular fluctuation of an output value of said permeability detecting means, said fluctuation being caused by said agitating means; and specifying means for specifying a location at which an abnormality has occurred based on said signal for driving said driving source, a signal outputted from said transmitting condition detecting means, and a signal outputted from said fluctuation detecting means.

* * * * *